US006545952B1

(12) United States Patent
Terzian

(10) Patent No.: US 6,545,952 B1
(45) Date of Patent: Apr. 8, 2003

(54) ORDERED MULTICHRONOGRAPHIC TIME SEQUENCES

(75) Inventor: Berj A. Terzian, Newbury, MA (US)

(73) Assignee: Equitime, Inc., Newbury, MA (US)

( * ) Notice: Subject to any disclaimer, the term of this patent is extended or adjusted under 35 U.S.C. 154(b) by 0 days.

(21) Appl. No.: 09/526,965

(22) Filed: Mar. 16, 2000

(51) Int. Cl.[7] ..... G04B 19/00; G04C 17/00; G04F 8/00

(52) U.S. Cl. ..... 368/223; 368/84; 368/112; 368/242

(58) Field of Search ..... 368/107, 110, 368/112–113, 82–84, 223, 242, 241, 239

(56) References Cited

U.S. PATENT DOCUMENTS 3,992,871 A * 11/1976 Numabe ..... 368/112
4,058,971 A * 11/1977 Epperson ..... 368/112
4,059,955 A * 11/1977 Prak ..... 368/188
4,089,156 A * 5/1978 Kashio ..... 368/112
4,194,352 A * 3/1980 Terzian ..... 368/239
4,316,276 A * 2/1982 Koehler et al. ..... 368/70
RE31,225 E * 5/1983 Willis et al. ..... 368/70
4,483,628 A * 11/1984 Terzian ..... 368/82
4,855,971 A * 8/1989 Meisner et al. ..... 368/188
4,888,748 A * 12/1989 Lagasse ..... 368/107
5,182,733 A * 1/1993 Terzian ..... 368/82
5,224,700 A * 7/1993 Rosen ..... 473/408
6,144,619 A * 11/2000 Reisman ..... 368/10

* cited by examiner

*Primary Examiner*—David Martin
*Assistant Examiner*—Michael L. Lindinger
(74) *Attorney, Agent, or Firm*—Muserlian, Lucas and Mercanti

(57) ABSTRACT

Ordered units and methods of multichronographic time sequences are provided which are operable to up count and down count such time sequences by using a single control element for each such type of count. These single control elements are manipulated in a unique series of momentary single, double and relatively long activations during the respective types of counts, thereby rendering more simplified and memorable the performance of such chronographic sequences using the single control element alone, one for each type of chronographic time count. These units and methods are provided in wristwatches which also exhibit digital displays of real time and include a further control element that is operable to switch the display in either direction between an ongoing chronographic time sequence and real time.

29 Claims, 3 Drawing Sheets

ORDERED MULTICHRONOGRAPHIC TIME SEQUENCES

BACKGROUND OF THE INVENTION

I. Field of the Invention

This invention relates to digital time displays which are useful for monitoring real time for general purpose timekeeping, as well as chronographic time sequences useful for specialized timing of discrete intervals encountered in various activities, such as games, sporting events, contests, cooking, examinations and countless others.

II. Description of the Prior Art

The current timepiece market, particularly wristwatches, offers many models which provide displays of real time for general purpose timekeeping of the user's normal daily activities, as well as chronographic timekeeping sequences useful for measuring the duration of discrete time intervals in special circumstances.

For example, a parent may rely on the real time display of a wristwatch to travel to, and arrive on time at, an athletic event in which his or her son or daughter will be a participant. Then he or she may switch the display to an up counting chronographic sequence to time the child's performance in a foot race by accruing the total amount of elapsed time between the start of the race and when he or she crosses the finish line.

As another example, a student may generally keep watch of his study time in order to complete it and arrive on time at a test of predetermined, scheduled time duration, say 90 minutes. Then he or she may switch his or her time display by presetting it to a 90 minute chronographic display, initiating the display to count down at the beginning of the test and thereby continuously monitor the time remaining throughout the 90 minute interval.

III. Recognition of Problems in the Prior Art

While such combinations of real time and chronographic time displays and functions are desirable and useful, especially in wristwatches, they have characteristics which present complications and problems. In particular, such products require manipulation of multiple crowns and/or buttons in varied and complex sequences which are perceived by many as difficult to perform even with the aid of written instructions in an owner's manual, and nearly impossible to memorize and perform by recall from memory, without reference to the manufacturer's instructions.

As a result, some consumers who have been attracted to the potential versatility and flexibility of multifunctional wristwatches of the type described above have experienced disappointment and dissatisfaction with the operational difficulty of using them to full advantage, particularly in the chronographic modes. Therefore, there has been a need to reduce or eliminate such problems in order to provide more easily operable wristwatches and other timepieces having multichronographic time sequence functions.

SUMMARY OF THE INVENTION

The present invention addresses and substantially alleviates or overcomes the above-discussed problems by providing ordered sequences of chronographic timekeeping which are far less difficult or complex than the conventional practices that exist in the current art. More particularly, the invention is based upon use of a single control element, for example, a push button, dedicated to begin one type of chronographic time sequence, for example, up counting time to determine the length of a chosen interval. This is followed by a singular series of manipulations which enable performing all of the functions of initiation, stopping, or optionally interrupting, resetting and repeating such sequences just by use of the same button. Likewise, the invention provides another single control element, for beginning and carrying out an opposite down counting chronographic time sequence, which permits initiation, presetting a defined time interval, and then starting it to count down to a zero end point, or optionally interrupting the down count, and repeating the sequence as often as desired just by use of the same control element.

In addition, the invention preferably includes optional further variations of the foregoing chronographic sequences such that each of the up counting and down counting sequences may be modified at the user's option to temporarily stop the function at any chosen initial time, with a display thereof for a long enough interval to enable viewing and/or recording it, while the function continues to run in memory. After such interval, the display reverts to a display of the ongoing function until it is stopped again at either a second chosen time, in the case of incrementing time, or automatically reaches zero, in the case of decrementing time. In this way, dual or multiple time intervals can be stopped and separately measured, again by use of the same single dedicated button.

Finally, and preferably, another control element may be provided which can be used to switch the display back and forth, at will, between real time and an ongoing chronographic time function, thus providing complete selectivity and flexibility of choice during such periods.

BRIEF DESCRIPTION OF THE DRAWINGS

FIGS. 1 and 2 include a crown between them in the watch case which preferably may be used to switch the display between real time and each of the chronographic functional time displays exhibited by FIGS. 1 and 2 as it is ongoing.

Referring now to FIG. 1, on its right is arc 10 representing the side of a digital wristwatch case having an upper button 12 located within the side of the case's upper right quadrant. Button 12 is springloaded to enable pushing it into the case momentarily either once or multiple times, or pressing and holding it in for a longer interval. Upon release, the button is automatically returned by the spring (not shown) to its normal outer rest position.

Figures 1, 2:
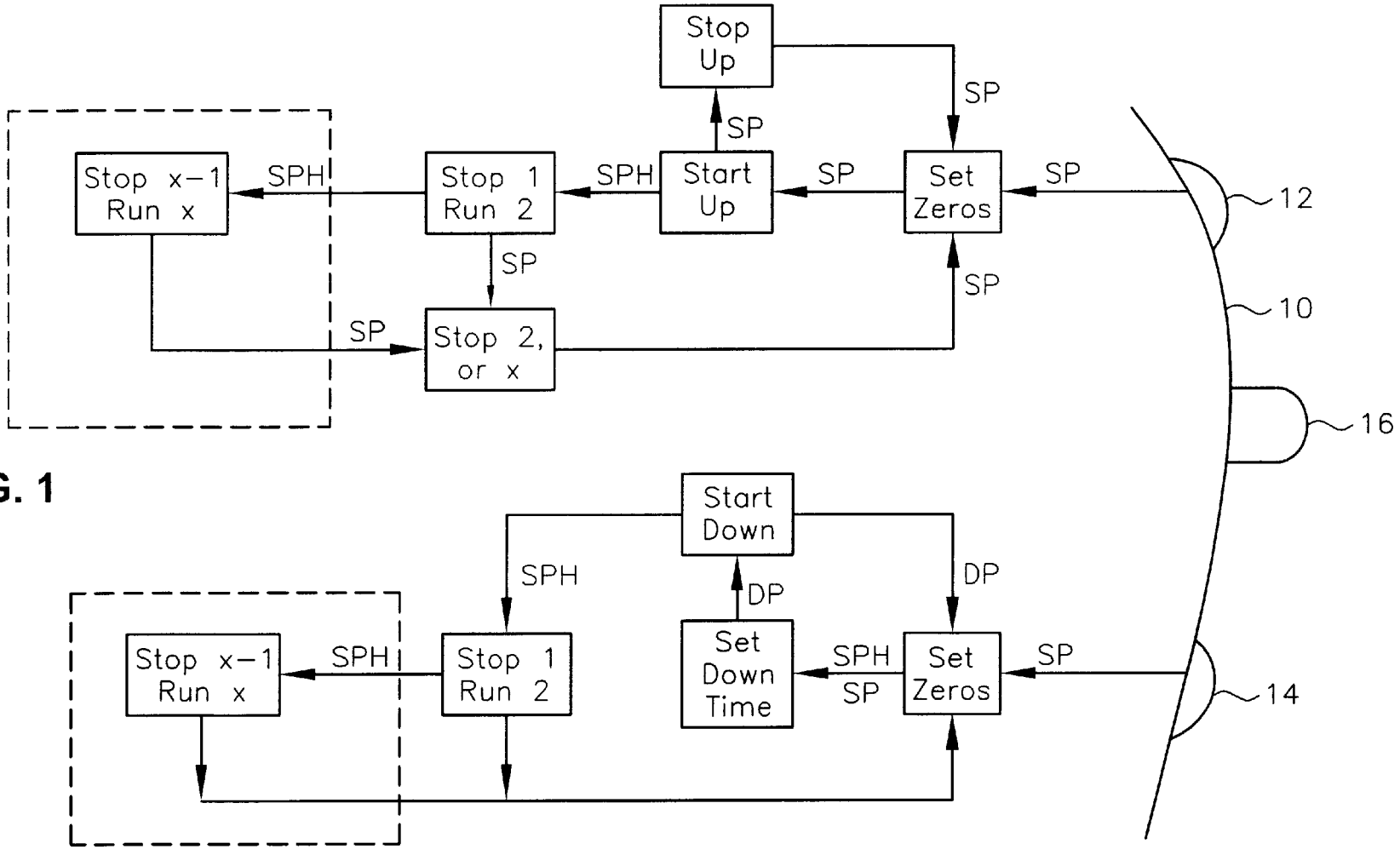
FIG. 1 is a preferred embodiment of a flow diagram for a single upper button on a wristwatch case showing how it may be used to initiate and conduct an incrementing chronographic function to measure single, dual or optionally multiple elapsed time intervals starting from zero time.
FIG. 2 is a similar preferred embodiment of a flow diagram for another single lower button on a wristwatch case showing how it may be used to initiate and conduct a decrementing chronographic function to measure single, dual or optionally multiple remaining time intervals starting from a preset amount of total time.
Figure 4:
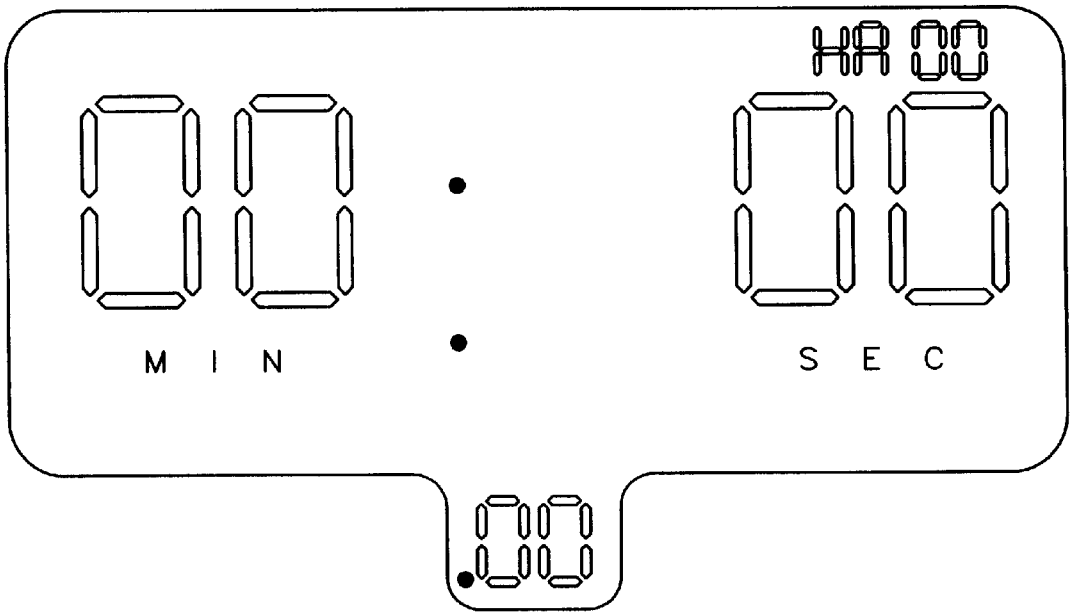
FIG. 4 is a view of the modified layout of FIG. 3 showing its appearance when initialized to a zero condition for conducting a chronographic time function.

Each rectangle in FIG. 1 represents a stage in the sequence of a microprocessor controlled incrementing chronographic time function operated by manipulation of button 12, "SP" designating a single momentary push, and "SPH" designating a single press and hold activation. To perform such sequence, the user gives button 12 a first SP push which converts the display from real time to a digital zero starting condition, i.e. "Set Zeros", as shown in FIG. 4. On the next SP push, the display begins counting time up, i.e. "Start Up", in units of tenths or hundredths of seconds, seconds, minutes and up to hours. On the next SP push, the display stops counting up and displays the total amount of elapsed time between the Start Up and Stop Up moments. Thereafter, another SP push of button 12 resets the display to the starting Set Zeros condition of FIG. 4. Thus, four consecutive single momentary SP pushes of the same button 12 are sufficient to perform one complete sequence of an incrementing chronographic time function. This sequence can be repeated as often as desired.

FIG. 1 includes an alternative sequence for use after "Start Up" has begun, which alternative is initiated by a single "SPH" press and hold of button 12. This causes the up counting display to stop for a predetermined interval while the up counting process continues in the chronograph's memory, such functions being indicated by the "Stop 1 Run 2" element, "1" being the intervening stop time shown by the display, while "2" represents the ongoing up count, which is returned to the display after a predetermined delay. Thereafter, another momentary SP push of button 12 stops and displays the total amount of time elapsed from the initial "Set Zeros" condition, as indicated by the element "Stop 2, or x". Another momentary SP push resets the display to the initial Set Zeros condition. In this way, first and second place finishes of a race, for example, can be readily timed.

The portion of the FIG. 1 diagram enclosed within the dashed rectangle represents an optional program for initiating further temporary stop and display functions by executing a second or multiple SPH press(es) and hold(s) on button 12. As a result, the display can be temporarily frozen for a second, or multiple, and finally i.e. x−1, times, each time to determine the corresponding elapsed interval after Start Up while the up count is continued in memory. A subsequent momentary push of button 12 stops the display for the last time, i.e. Stop x, to cease the counting up process and display the total elapsed time. Thereafter, another single SP push resets the display to the start zeros condition.

It will be appreciated that the flow diagram and the button manipulations illustrated in FIG. 1 are highly ordered and therefore easily memorized and performed. First, button 12 is in an upper position on the watch case and can be readily recognized as the one that is logically dedicated to performing all up counting of chronographic time. Secondly, to up count a single interval of chronographic time, it can be just as easily remembered that this is accomplished with single momentary SP pushes of button 12 to initialize the display at Set Zeros, and thereafter to start the count, stop it and reset the display to the initial zero condition.

On the other hand, in order to momentarily freeze the display at a first or multiple intervening moment(s), while up counting in memory continues, it is easy to learn and remember that this is accomplished by pressing and holding button 12, i.e. SPH, in contrast to the single momentary SP push that is restricted to timing and ending one sequence, or the last segment of one sequence, of total up counted elapsed time. Thereafter, two single pushes SP are again the normal means for stopping the up count for a last time and resetting the display to zero starting condition.

The momentary SP pushes of button 12 are preferably programmed to be effective by contact of the button with a terminal within the watch case for from about one half up to about one second maximum. In contrast, the press and hold SPH pushes are preferably programmed to require contact times of at last three to four seconds, to differentiate sufficiently between these two types of button manipulations. Also, the temporarily frozen intervening displays created by the SPH cycle(s) of FIG. 1 are preferably programmed to remain on display for 10 to 15 seconds so that they may be viewed and recorded, if desired, before the display automatically reverts to showing the continuing up count from the chronograph memory.

Referring now to FIG. 2, diagramed there are decrementing chronographic time sequences which are microprocessor controlled and operated by manipulation of the single push button 14 preferably located within the side of a watch case's lower right quadrant. The SP and SPH designations in FIG. 2 have the same meaning as described above for FIG. 1. In addition, "DP" in FIG. 2 represents double, rapidly performed, consecutive momentary pushes of button 14 which are used only in down counting chronographic time sequences.

Thus, a single SP push of button 14 again converts the display to an initial Set Zeros condition. Thereafter, alternating SPH and SP activations of button 14 are programmed to run up the various magnitudes of time in the initial, all zeros display to the total desired quantity of time that is to be down counted. Preferably, this sequence begins by a first SPH press on button 14 which initiates flashing of the unit seconds zero digit in the display. Thereafter, single SP pushes of button 14 will increment the flashing digit to any value in the range of 1 to 9 units, if desired. Alternatively, that digit value may be left unchanged at zero if that much specificity is not wanted or needed as part of the quantity of preset down time.

In either case, the next SPH press of button 14 will initiate flashing of the tens of seconds zero digit in the display, and subsequent single SP pushes on button 14 will then increment the flashing digit to whatever value of tens of seconds, ranging from 1 to 9, is to be included in the preset amount of down time. The same alternating sequence of one SPH followed by one or more SP pushes on button 14 is used to increment the remaining zero digits, as needed, in ascending order of unit minutes, tens of minutes, unit hours and tens of hours, whereby the total amount of time to be down counted is preset in the display. Upon completion, this condition readies the display and the counter in the chronograph memory to down count that length of time, as represented by the element labeled "Set Down Time" in FIG. 2.

Next, the down count is initiated by a rapid double "DP" push on button 14. If left undisturbed, this down count will continue until the entire preset time has elapsed and the display has returned to a Set Zeros condition. Thereafter, a second down time can be preset on the display by the same alternative SPH, SP manipulations of button 14, as described above, followed by the rapid double DP pushes of the button to begin a countdown of the second chosen preset time on the display.

To provide additional flexibility and choices in operating the above-described decrementing chronographic time sequence, two further options are included in the FIG. 2 flow diagram. One is a second DP double push of button 14 which, if executed at any time after the down count has started, will immediately terminate this progression and restore the display to the Set Zeros condition of FIG. 4. This enables a cancellation of the decrementing function if for any reason such cessation is desired or necessary.

Another option is to perform an SPH press and hold activation of button 14. This will immediately freeze the display at that moment, while down counting continues in the chronograph memory. Like the similar procedure described above for the incrementing diagram of FIG. 1, this frozen display will be exhibited for a 10 to 15 second interval so that it may be viewed, noted and, if desired, recorded, before the display automatically reverts to exhibiting the ongoing down count in the chronograph memory. This process is carried out by the element labeled "Stop 1 Run 2" and, similar to FIG. 1, allows timing a partial elapsed interval of the total down count preset at the commencement of the decrementing function, as well as completion of the latter by its ongoing return to the initial Set Zeros condition.

Also, the portion of FIG. 2 enclosed within the dashed line represents an optional capability of permitting multiple interventions in the entire decrementing process. This is done by performing repeated SPH press and hold pushes on button 14 until the last Stop x−1; the counter is thereafter allowed to continue with a display of the last x segment of the full countdown. Thus, as in FIG. 1, this optional feature permits intervening in the entire countdown once, or two or more times, whenever desired or needed.

Figure 3:
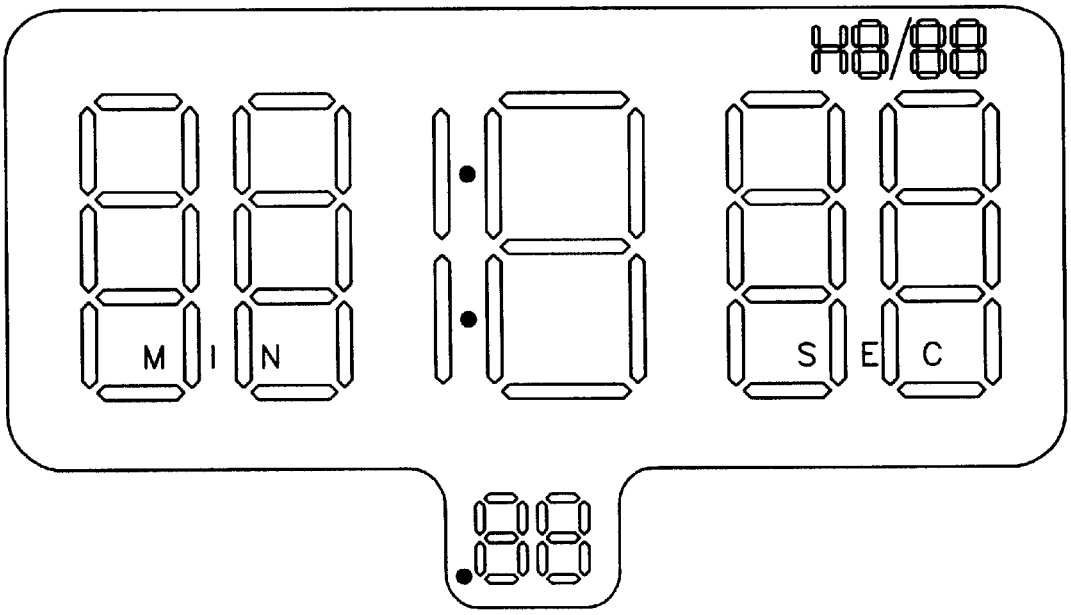
FIG. 3 is a view of a layout of display elements shown in FIG. 1 of U.S. Pat. No. 4,271,497, modified with added elements for enabling the display to show a zero starting condition when either of the chronographic time functions of FIGS. 1 and 2 is initiated.

Referring now to FIG. 3, this is a modified version of FIG. 1 of U.S. Pat. No. 4,271,497, which describes quadribalanced digital time displays. The modifications, beginning at the top of FIG. 3, include the addition of an "H8/" set of display elements which enables displaying, during real time, the month date on the left, separated by the inclined slash mark from the adjacent day date on the right. These display elements are convertible during chronographic timekeeping to a display of hours "HR" of up to 19 hours duration, beginning with the zero hours display shown in FIG. 4.

Further modifications in the middle section of FIG. 3 comprise addition of "MIN", a colon, ":" and "SEC" amidst the display elements which, during real time, display remaining minutes, current and next hours and elapsed minutes, respectively, as described in U.S. Pat. No. 4,271,497. And, finally, at the bottom of FIG. 3, a decimal point "." is added to the left of the display elements which, during real time, display 0 to 59 incrementing seconds during each elapsed minute of the first half hour and 59 to 0 decrementing seconds during each remaining minute of the second half hour.

With these modifications, the display elements of FIG. 3 are switched from displaying real time to the Set Zeros condition shown in FIG. 4 whenever button 12 or 14 is given an SP push to initiate chronographic time sequences in accordance with the flow diagrams of FIGS. 1 and 2. FIG. 4 shows a double set of figure eight display elements to the right of the decimal point representing magnitudes of tenths and hundredths of seconds. Since as a practical matter the buttons 12 and 14 cannot be hand operated to an accuracy within hundredths of a second, an alternative option is to extinguish the hundredths zero digit and display only the tenths seconds values during chronographic time sequences. For the same reason, the up counted chronographic time sequences controlled by button 12 can be limited to tenths of seconds.

FIGS. 3 and 4 illustrate the fact that the chronographic time sequences of this invention can be incorporated in a wristwatch or other timepieces that display the real time quadribalanced time displays described in U.S. Pat. No. 4,271,497. A similar combination can be made with the enhanced quadribalanced time displays of U.S. Pat. No. 6,215,736 B1.

Also, FIGS. 1 and 2 include a crown 16 centrally positioned between buttons 12 and 14. This crown may be constructed and operated in accordance with U.S. Pat. No. 4,720,823, which describes a push-pull single crown used to perform real time setting functions for a balanced digital time display, as well as for alarm settings. That crown can be incorporated as the crown 16 of this invention, with a modification consisting of providing it with a single, spring biased push-in capability, similar to the previously described SP pushes for buttons 12 and 14. As a result, the crown 6 can be programmed to switch the display in either direction between the chronographic displays of FIG. 1 or 2 and real time each time the crown 16 is given a single SP push into the watch case 10. This allows the user to monitor, at will, either type of time information during the course of the chronographic time sequences.

Figure 5:
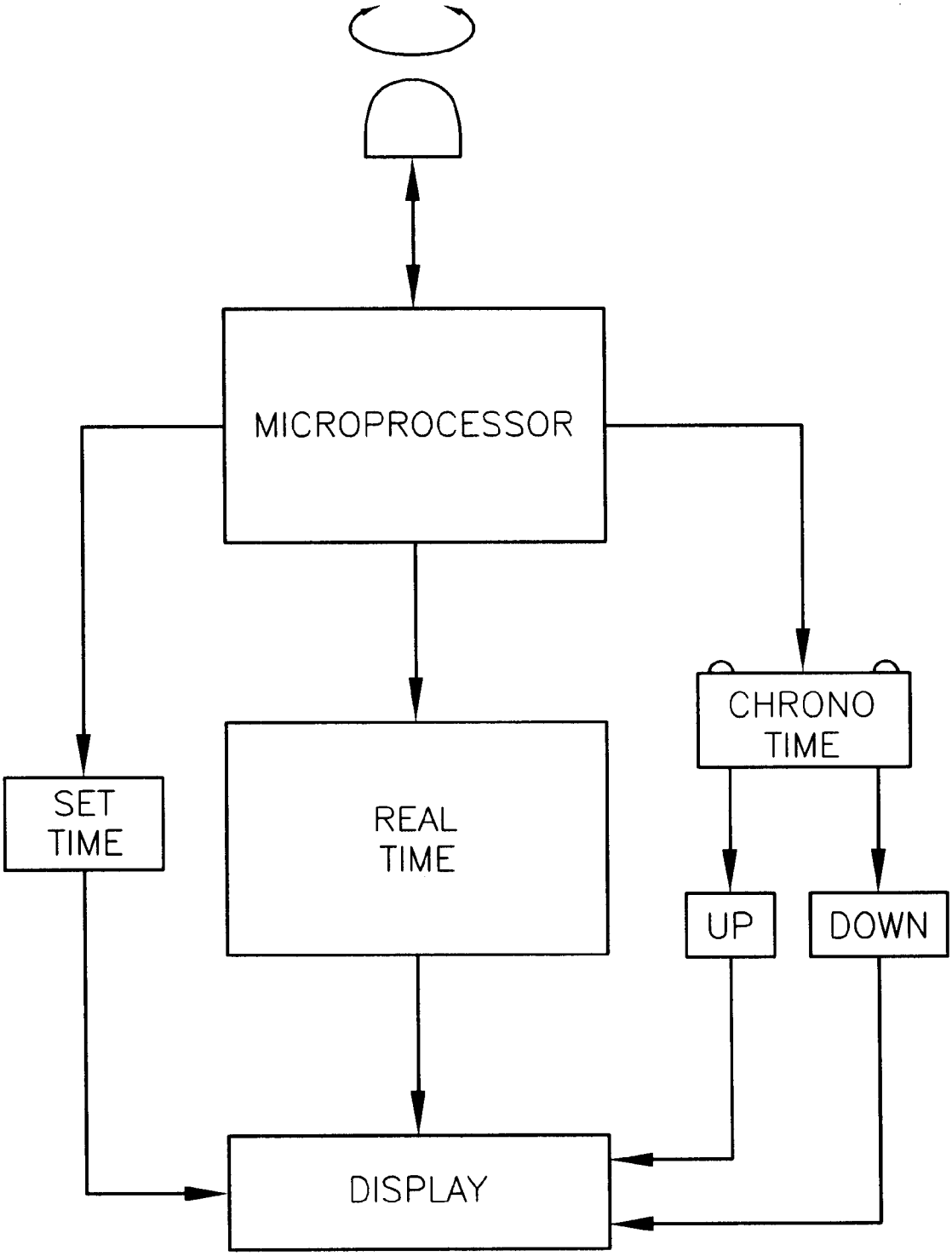
FIG. 5 is a diagram of interconnections between the buttons and crown of FIGS. 1 and 2, and other logic elements, that enable switching such displays under microprocessor control between real time and an ongoing chronographic time function.

Referring now to FIG. 5, this diagram shows the overall architecture of a system that embodies all of the above-described preferred embodiments. At the top is a crown 16 which can be rotated in either clockwise or counterclockwise directions to perform the functions of switching between, and setting and resetting, real and alarm times, as described in U.S. Pat. No. 4,720,823. The crown 16 is also spring biased to switch between a relatively outer rest position and a pushed in position which then makes, and when released breaks, contact with a programmed microprocessor 18 terminal to alternate the display 20 between real time and chronographic time, as described above.

When switched into the chronographic time mode, buttons 12 and 14 are operable to perform the previously described up counting and down counting chronographic time sequences of FIGS. 1 and 2 under microprocessor control of the corresponding digital up and down counters in the chronographic portions of the system. Accordingly, the simplification and ease of operation provided by the sequences of FIGS. 1 and 2 can be readily incorporated in a system constructed in accordance with the design of FIG. 5 and embodied in a variety of timepieces such as wristwatches, chronometers, stop watches, clocks or any other time telling instrument in which the ordered chronographic time functions of this invention are desired. Also, one or both of the ordered chronographic time sequences can be combined not only with the previously cited quadribalanced or enhanced quadribalanced displays, but also in timepieces that operate with conventional real time digital displays.

It should be noted that while buttons 12 and 14 are the preferred form of control elements, other types can be used, such as touch pads, rotatable dials, slide tabs, or any other element that can be hand operated to alternate between make and break positions in accordance with sequences of FIGS. 1 and 2. Such controls can be located in any desired position on a timepiece embodying the invention, such as the front face, or one or two sides of a wristwatch, the top or sides of stop watches or clocks, or on a remote control device that beams SP, SPH and DP infrared control signals to sensors on a time display spaced a distance away. Furthermore, one or both of the sequences of FIGS. 1 and 2 can be incorporated in strictly chronographic instruments without a real time display.

This invention has been described above in terms of its operative principles as well as preferred embodiments. It should be apparent to those skilled in the art that the overall architecture of the flow diagrams of the preferred embodiments shown in FIGS. 1 and 2 provides significant simplification in the selection and execution of chronographic time sequences due to the use of dedicated control elements that reflect singularities of function and operation. In particular, all of the count up incrementing sequences are initiated and operated with a single control element, e.g. button 12, located in a relatively upper position on the watch case, whereas all of the countdown decrementing sequences are also operated with a single control element, e.g. button 14, located in a relatively lower position on the case. These logical singularities are simple, easy to choose between, and unforgettable.

The up counting sequences are started and stopped with SP pushes on button 12. On the other hand, the down counting sequences, after the display is preset to the amount of time to be decremented with SPH, SP pushes, are started and, if desired, canceled with DP pushes on button 14, again providing singularities as well as contrast between the up counting and down counting control functions. Finally, both the up counting and down counting sequences can be momentarily sampled at any chosen time(s) with SPH pushes on either button 12 or 14, thus providing a common type of control element operation for accomplishing the same intervening function in either kind of ongoing chronographic sequence. Again, this can be readily remembered and recalled from memory whenever desired.

It should be understood that the preferred embodiments described herein are only illustrative. Many variations of such embodiments will be evident to those skilled in the art, without departing from the operating principles and scope of this invention. Therefore, the following claims should be understood as intended to cover all such variations and alternative embodiments that incorporate the inventions defined therein and all equivalents thereof.

The following is claimed:

1. An ordered multichronographic time sequence unit embodied in a wristwatch which provides a quadribalanced or an enhanced quadribalanced digital real time display, said unit consisting of:

a single control element operable to control and display an up counting chronographic time sequence in the digital display provided by the wristwatch, said element being operable by a single momentary activation, referenced herein as SP;

a first SP activation being effective to set the digital display into an all zeros condition;

a second SP activation being effective to commence up counting in the display;

a third SP activation being effective to stop up counting in the display and to provide therein the corresponding elapsed time; and a fourth SP activation being effective to again set the display into an all zeros condition, whereby the up counting sequence may be performed and repeated by use of solely the single control element.

2. An ordered unit according to claim 1 wherein said control element is also operable by a single relatively long activation, referenced herein as SPH;

at least one SPH activation, performed after commencement of up counting, being effective to freeze the display at the corresponding elapsed time of that intervening moment while up counting continues in chronographic memory, said intervening elapsed time being provided in the display for a predetermined time interval after which the display reverts to displaying the ongoing up count in the chronographic memory;

a single SP activation thereafter being effective to stop up counting and provide the resulting total elapsed time in the display; and a next single SP activation being effective to again set the display into an all zeros condition, whereby the up counting sequence, with one or more of the frozen intervening moments, may be performed and repeated by use of the single control element.

3. An ordered unit according to claim 2 wherein said control element is a spring biased push button that may be pushed momentarily into activation to perform the SP operation and may be pressed and held for a longer interval to perform the SPH operation, the push button, upon release in both cases, being returned by the spring bias into a normal rest position of non-activation.

4. An ordered unit according to claim 3 wherein said push button is located in the side of a wristwatch case.

5. An ordered unit according to claim 1 wherein said control element is responsive to momentary SP activation for from about one half second up to about one second.

6. An ordered unit according to claim 2 wherein said control element is responsive to relatively long SPH activation for from about three to about four seconds, and the intervening elapsed time is provided in the display for from about 10 to about 15 seconds.

7. An ordered unit according to claim 1 wherein a separate control element is effective to switch the display in either direction between an ongoing up counting time sequence and the real time display.

8. An ordered unit according to claim 7 wherein said separate control element is a spring biased push button that may be pushed into switching activation and upon release is returned by the spring bias into a normal rest position of non-activation.

9. An ordered multichronographic time sequence unit embodied in a wristwatch which provides a quadribalanced or an enhanced quadribalanced digital real time display, said unit consisting of:

a single control element operable to control and display a down counting chronographic time sequence in the digital display provided by the wristwatch, said element being operable by a single momentary activation, referenced herein as SP, by a double momentary activation, referenced herein as DP, and by a single, relatively long activation, referenced herein as SPH;

a first SP activation being effective to set the digital display into an all zeros condition;

subsequent consecutive pairs of SPH, SP activations being effective to flash and increment, respectively, zero digits in the display in ascending order of time magnitudes comprising hundredths or tenths of seconds, units and tens of seconds, units and tens of minutes and units and tens of hours, to preset in the display a quantity of time desired to be down counted to zero as the end point; and a DP activation thereafter being effective to commence down counting of the preset time quantity in the display until the display returns to an all zeros condition as the end point, whereby the down counting may be performed and repeated by use of solely the single control element.

10. An ordered unit according to claim 9 wherein at least one SPH activation, performed after commencement of down counting, is effective to freeze the display at the corresponding down counted time of that intervening moment while down counting continues in chronographic memory, said intervening down counted time being provided in the display for a predetermined time interval after which the display reverts to displaying the ongoing down count in the chronographic memory until the display returns to the all zeros end point.

11. An ordered unit according to claim 10 wherein after commencement of down counting, a DP activation of said control element is effective to terminate said down counting and return the display into an all zeros condition.

12. An ordered unit according to claim 10 wherein said control element is a spring biased push button that may be pushed momentarily into activation to perform the single SP and the double DP operations, and may be held for a longer interval to perform the SPH operation, the push button, upon release in all three cases, being returned by the spring bias into a normal rest position of non-activation.

13. An ordered unit according to claim 12 wherein said push button is located in the side of a wristwatch case.

14. An ordered unit according to claim 9 wherein said control element is responsive to momentary SP activation for from about one half second up to about one second.

15. An ordered unit according to claim 10 wherein said control element is responsive to SPH activation for from about three to about four seconds, as a result of which the corresponding down counted time is provided in the display for from about 10 to about 15 seconds.

16. An ordered unit according to claim 9 wherein a separate control element is effective to switch the display in either direction between an ongoing down counting time sequence and the real time display.

17. An ordered unit according to claim 16 wherein said separate control element is a spring biased push button that may be pushed into switching activation and upon release is returned by the spring bias into a normal rest position of non-activation.

18. An ordered method of chronographic timekeeping performed with a wristwatch which provides a quadribalanced or an enhanced quadribalanced digital real time display, said method consisting of:

providing a single control element in the wristwatch operable to control and display an up counting chronographic time sequence, said element being operable by a single momentary activation, referenced herein as SP;

performing a first SP activation to set the display into an all zeros condition;

performing a second SP activation to commence up counting in the display;

performing a third SP activation to stop up counting in the display and to provide therein the corresponding elapsed time; and performing a fourth SP activation to again set the display into an all zeros condition, whereby the up counting sequence may be performed and repeated by use of solely the single control element.

19. An ordered method according to claim 18 wherein said control element is also operable by a single relatively long activation, referenced herein as SPH;

performing at least one SPH activation, after the commencement of up counting in the display, to freeze the display at the corresponding elapsed time of that intervening moment while continuing up counting in chronographic memory and providing the intervening elapsed time in the display for a predetermined time interval, with reversion thereafter of the display to displaying the ongoing up count in the chronographic memory;

performing a single SP activation to stop up counting in the display and provide therein the total elapsed time subsequent to the commencement of up counting; and performing another single SP activation to again set the display into an all zeros condition, whereby the up counting sequence may be performed, with one or more frozen intervening moments, by use of solely the single control element.

20. An ordered method according to claim 18 which includes providing another separate control element operable to switch the display in either direction between an ongoing up counting time sequence and the real time display.

21. An ordered method of chronographic timekeeping performed with a wristwatch which provides a quadribalanced or an enhanced quadribalanced digital real time display, said method consisting of:

providing a single control element in the wristwatch operable to control and display a down counting chronographic time sequence, said element being operable by a single momentary activation, referenced herein as SP, a double momentary activation, referenced herein as DP, and a relatively long activation, referenced herein as SPH;

performing a first SP activation to set the display into an all zeros condition;

performing subsequent consecutive pairs of SPH, SP activations to flash and increment, respectively, zero digits in the display in ascending order of hundredths or tenths of seconds, units and tens-of seconds, units and tens of minutes, and units and tens of hours, to the extent required to preset in the display a quantity of time desired to be down counted to zero as the end point; and thereafter performing a DP activation to commence down counting of the preset time quantity until the display returns to an all zeros condition as the end point, whereby the down counting sequence may be performed and repeated by use of solely the single control element.

22. An ordered method according to claim 21 which includes performing at least one SPH activation, after the commencement of down counting in the display, to freeze the display at the corresponding down counted time of that intervening moment while continuing down counting in chronographic memory and while providing the intervening down counted time in the display for a predetermined time interval, with reversion thereafter of the display to displaying the ongoing down count in the chronographic memory until the display returns to an all zeros condition as the end point.

23. An ordered method according to claim 21 which includes performing second DP activation, after commencement of down counting in the display, in order to terminate said down counting and return the display into an all zeros condition.

24. An ordered method according to claim 21 which includes providing another separate control element operable to switch the display in either direction between a down counting time sequence and the real time display.

25. A quadribalanced or enhanced quadribalanced digital time display unit embodied in a wristwatch, said unit consisting of:

hours display element means for displaying digital values of hours from 1 to 12;

first minutes display element means flanking the hours display means on the right for displaying elapsed minute values in a relatively upper position during the first quarter and in a relatively lower position during the second quarter of a current hour;

second minutes display element means flanking the hours display means on the left for displaying remaining minute values in a relatively lower position during the third quarter and in a relatively upper position during the fourth quarter of the current hour, with the hour value displayed by the hour display means then advanced to the next hour;

means for displaying an abbreviation for chronographic minutes on the left side of the hours display means;

means for displaying an abbreviation for chronographic seconds on the right side of the hours display means; and means for displaying a colon between the minutes and seconds abbreviations display means; wherein the display may be switched between quadribalanced timekeeping and an all zeros chronographic time condition displayed by the first and second minutes display means, coupled with displays of the abbreviations for chronographic minutes and seconds and the colon by the respective means therefor.

26. A digital time display unit according to claim 25 wherein the abbreviations for chronographic minutes and seconds comprise MIN and,SEC, respectively.

27. A digital time display unit according to claim 25 which further includes means for displaying below the hour display means values of seconds ranging between 0 and 59 in either direction, and means for displaying a decimal point to the left of the seconds display means, wherein when switched to the all zeros chronographic time condition the display will include a display of the decimal point and one or both of a pair of zero seconds values useful for displaying tenths or hundredths of seconds during intervals of chronographic timing.

28. A digital time display unit according to claim 27 which further includes a set of five display element means configured as the letter H flanked on the right by three successive sets of seven display element means each configured as the digit 8, wherein said means are adapted to display digital values of the current month and day dates during quadribalanced timekeeping and when switched to the all zeros chronographic time condition the display will include a display of HR followed by a pair of zero values useful for displaying values of hours during intervals of chronographic timing.

29. A digital time display unit according to claim 25, which further includes means for displaying a slash mark between the first and second sets of seven display element means during quadribalanced timekeeping to provide separation between the displayed month and day dates.

* * * * *